US005118925A

United States Patent [19]

Mims et al.

[11] Patent Number: 5,118,925

[45] Date of Patent: Jun. 2, 1992

[54] ELECTROMAGNETIC INTERFERENCE SHIELDING DEVICE FOR IMAGE INTENSIFIERS

[75] Inventors: William D. Mims; Raymond F. Griffin, Jr., both of Roanoke, Va.

[73] Assignee: ITT Corporation, New York, N.Y.

[21] Appl. No.: 566,139

[22] Filed: Aug. 13, 1990

[51] Int. Cl.[5] ..... H01J 31/50; H01J 40/14

[52] U.S. Cl. ..... 250/213 VT; 174/35 R

[58] Field of Search ..... 250/213 VT; 361/111, 361/424; 313/527, 528, 532; 315/85; 357/23.13; 174/35 R

[56] References Cited

U.S. PATENT DOCUMENTS 4,245,160 1/1981 Harao ..... 250/213 VT 4,709,140 11/1987 Oba ..... 313/527

4,924,080 5/1990 Caserta et al. ..... 250/213 VT

*Primary Examiner*—David C. Nelms

*Assistant Examiner*—S. Allen

*Attorney, Agent, or Firm*—Arthur L. Plevy; Patrick M. Hogan

[57] ABSTRACT

A device for shielding an image intensifier from electromagnetic interference which includes a hollow conductive mantle surrounding the image intensifier and over the end except for light input and output windows. It is adapted to be electrically connected to a ground reference potential for diverting electromagnetic interference to the ground reference potential, and in this capacity, functions as a Faraday cage. The mantle contains a conductive plate, preferably in the form of a sleeve, affixed within it. The conductive plate is insulated from the mantle by a layer of dielectric substance. The conductive plate is adapted to be electrically connected with an input lead for powering the image intensifier; the conductive member, the interposed dielectric substance and the mantle comprising a bypass capacitor for the input power lead.

25 Claims, 4 Drawing Sheets

ELECTROMAGNETIC INTERFERENCE SHIELDING DEVICE FOR IMAGE INTENSIFIERS

BACKGROUND OF THE INVENTION

1. Field of the Invention

The present invention relates to a metal shield (Faraday Cage) for an image intensifier which shield also provides a bypass capacitor for a power lead coupled to said image intensifier.

2. Description of the Prior Art

An image intensifier is used to amplify the brightness of faint image of an object to enable one to obtain a clearer view of the object. Such devices have been widely employed both commercially and by the military in various applications. An important use of the image intensifier is in night vision equipment. Night vision equipment is frequently employed by the military as the principal means of maintaining necessary visual awareness of the environment during nighttime operations. For example, a helicopter pilot may be required to pilot his aircraft in the dark and at low altitudes with night vision goggles being the primary means for seeing the landscape. Accurate visual awareness is critical in situations of this nature. Electromagnetic interference (EMI) can interfere with the operation of image intensifiers. If an unshielded image intensifier is used in an environment having appreciable EMI, brightness changes in the output image can result, thereby depriving the wearer of accurate visual data, and therefore creating an unacceptable risk. Thus the image intensifier should be adequately shielded against EMI. An example of prior art shielding can be had by referring to a U.S Pat. No. 4,924,080 awarded in May, 1990 to J. Caserta, W. Mims, J. Bowman and J. Reed, filed on Jul. 5, 1988, and entitled *ELECTROMAGNETIC INTERFERENCE PROTECTION FOR IMAGE TUBES*, and assigned to the assignee herein by the inventors herein. The aforesaid application describes a shielding device for an image intensifier which employs a Faraday Cage for surrounding the intensifier tube and its power supply and includes a set of capacitors for capacitively bypassing the incoming power leads to the tube's power supply. Although of great utility, the foregoing invention requires capacitors which occupy significant space and require relatively complex and expensive assembly. Further, the foregoing invention provides a limited frequency blocking range because the capacitors are descreat rather than uniformly distributed and the descreat capacitor exhibit inductance at high frequencies. Naturally, it is preferable for intensifier equipment to be of minimum size, weight, complexity and cost, and to have EMI shielding means that are maximally effective.

The present invention provides improved EMI shielding and improved power lead capacitor bypassing for an image intensifier via a simple, economical device. The device to be described is also compatible with and retrofitable to existing image intensifiers.

SUMMARY OF THE INVENTION

The problems and disadvantages associated with the conventional techniques and devices utilized to shield image intensifier tubes from electromagnetic interference are overcome by the present invention which includes a Faraday Cage surrounding the image intensifier at least along its length, adapted to be electrically connected to a ground reference potential for diverting electromagnetic interference to that ground reference potential. The Faraday Cage contains a coaxial conductive member fabricated within it. A dielectric substance is interposed between the Faraday Cage and the conductive member. The conductive member is adapted to be electrically connected with an input lead for powering the image intensifier; the conductive member, the interposed dielectric substance, and the Faraday Cage forming a very distributed bypass capacitor with no inductance for the input power lead.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
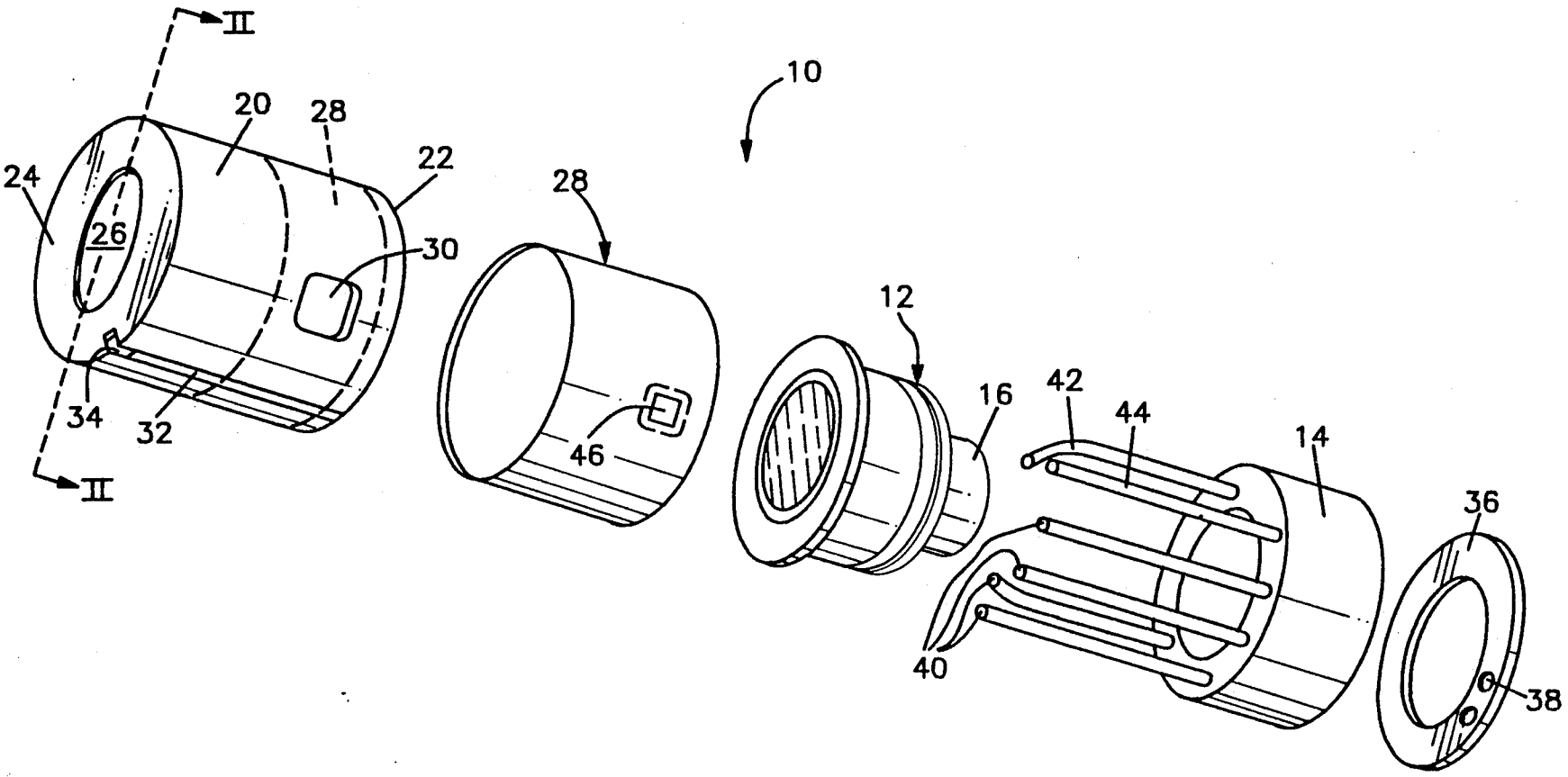
FIG. 1 is an exploded perspective view of an image intensifier assembly including, an image intensifier tube, power supply, backplate and EMI shield in accordance with an exemplary embodiment of the present invention.

FIG. 1 depicts an exploded perspective view of an image intensifier assembly 10. Typically, a battery or other convenient low voltage source is utilized as the source of electrical power. To better center the weight, the battery is worn on the person of the user of the device, e.g., attached to the back of his helmet. For a typical user of such an intensifier tube's night vision imaging system, reference is made to a technical manual TM 11-5855-263-3C entitled: *AVIATION INTERMEDIATE MAINTENANCE MANUAL, AN/AVS-6(V)1(NSN* 5855-01-138-4749), published by the Department of the Army, Jul. 8, 1983. The assembly 10 includes an image intensifier tube 12 wherein the process of light intensification occurs as shall be more fully described below. A power supply 14 is contained within a toroidal housing and converts the input voltage of say, a battery, to a plurality of outputs for powering the various stages of the intensifier tube 12. The toroidal shape of the power supply 14 enables it to fit coaxially over a fiber optic output section 16 of the intensifier tube 12 and permits a compact cylindrical configuration to be maintained. In addition, the power supply mechanically supports the intensifier tube within the EMI shield 18. The EMI shield 18 of the present invention has a hollow conductive mantle (Faraday Cage) 20 having an open end 22 and an end with a peripheral flange 24. Although a cylindrical mantle 20 is depicted, the mantle 20 can be designed with any cross-sectional shape, e.g., octagonal. An aperture 26 permits light to enter the shield 18 to be processed by the intensifier tube 12 which is slideably received within the shield 18. The shield 18 has an internal ring-shaped conductive member or sleeve 28 (depicted in dashed lines) which is electrically insulated from the mantle 20 by a dielectric layer as shall be described at length below. Although a ring-shaped conductive member is shown and described, an incomplete ring or another shape could be employed, e.g., a plate-like conductive member conforming to the interior shape of the mantle. A contact window 30 is provided through the mantle 20 to allow an electrical contact to be made with the sleeve 28. An air pressure equalization groove 32 extends from the flanged end 24 to the open end 22 of the mantle 20 to provide a conduit for air to travel from one end of the assembly to the other. To insure proper orientation of the shield in the housing, the shield is provided with a registration notch 34 which registers with a mating prominence in the housing (see FIG. 2). A backplate 36 is slideably received within and seals the open end 22 of the mantle. The backplate 36 is provided with access openings 38 to allow adjustment of the power supply potentiometers. To assemble the image intensifier assembly, the output leads 40 from the power supply 14 are affixed to their respective contacts (not shown) on the tube 12, the positive input or B+ lead 42 is then affixed to the sleeve 28, and the grounding or B− lead 44 is affixed to the interior of the mantle 20. The tube 12 and power supply 14 can then be inserted into the mantle 20 and the backplate 36 pressed into the open end 22. A dielectric filler and sealant may be injected into the assembly to fill any empty spaces around the components, thereby shockproofing and waterproofing the assembly.

The mantle 20 is constructed of an electrically conductive material, preferably drawn or spun aluminum. As space and material economy is desirable, the thickness of the mantle wall is kept to a minimum. In actual applications, the walls of the mantle 20 have been made with a thickness of approximately 0.009 inch. This thickness is not critical, however, and is merely illustrative, the actual thickness used depending on the application. A stamping process wherein an aluminum tube is subjected to a suitable die is one convenient method of simultaneously forming the flanged end 24, registration notch 34, contact window 30, and air equalization groove 32. It should be noted that the registration notch 34 could be relocated to any convenient location on the mantle 20 and/or could be substituted with any suitable projection or recess which registers with a mating recess or projection emanating from the protective housing to establish a fixed orientation. For certain applications, it may be desirable for the image intensifier assembly to be rotatable, and in those instances, a registration notch 34 would be omitted. Similarly, the air equalization groove 32 may not be necessary for every application of the present invention. It is noteworthy that the groove 32, if incorporated, does not penetrate the mantle wall, nor does it intrude into the interior of the mantle, thus a smooth interior wall and a mechanically sturdy and continuous cylinder is preserved. In forming the groove 32, therefore, the stamping process must displace metal to either side of it or, alternatively, it may be formed by the removal of material as by, for example, grinding. The sleeve 28 is formed from the same or similar material as the mantle 20, preferably spun or drawn aluminum, and would typically have the same wall thickness. The outer diameter of the sleeve 28 is selected relative to the inner diameter of the mantle 20 such that there is a line-to-line or interference fit when the sleeve 28 is inserted within the mantle 20. For example, the outer diameter of the sleeve 28 could be equal to, or 0.001 inch larger than the interior diameter of the mantle 20. The contact window 30 permits an input lead to be passed therethrough to make conductive contact with a suitably prepared surface of the sleeve 28. Prior to assembly, both the mantle 20 and the sleeve 28 are anodized in their entirety. Anodizing the aluminum yields a surface coating of alumina, $Al_2O_3$, a dielectric substance having a relative dielectric constant of 8.8. The thickness of the alumina layer, and hence its dielectric strength, can be controlled by varying the anodizing voltage and time. The sleeve 28 is assembled in the mantle 20 by heating the mantle sufficiently to expand it internally and allow the sleeve, which is not heated, to be inserted therein. For example, a mantle 20 having an internal diameter 1.407 inches expands to about 1.413 inches when heated from 20 degrees Centigrade to 200 degrees Centigrade. An appropriately sized sleeve 28 having an external diameter approximately equal to the internal diameter of the mantle 20, when both are cool, can easily be inserted into the heated and expanded mantle 20 to a selected depth. Once the sleeve 28 is positioned, the mantle 20 is allowed to cool, whereupon it returns to its original dimensions thereby gripping the sleeve 28 tightly and sandwiching two layers of alumina between the sleeve 28 and the mantle 20. This configuration of a pair of conductors held a fixed distance apart and electrically insulated from one another by a dielectric interposed between them constitutes a capacitor. Thus the EMI shield 18 of the present invention is a Faraday cage due to its being a grounded conductor shroud and is also simultaneously a capacitor. The capacitance function of the EMI shield 18 is utilized by removing small areas of the alumina coating from the sleeve 28 and the mantle 20 in order to provide a suitable substrate for connecting the respective electrical leads. This is accomplished by, for example, abrading away the alumina by sandblasting or by chemical etching. An area that has been stripped of alumina exposing the underlying aluminum would then typically be treated to prepare the aluminum to receive the applications of an electrical contact, such as, a soldered or glued connection. The pretreatment of the exposed aluminum by, for example, electroplating or by metallic evaporation and sublimation, preserves the area from corrosion and renders it a suitable receptor for solder or adhesive. The sleeve 28 is so treated in a contact area 46 which aligns with the contact window 30 to allow a lead to make contact with the sleeve 28 through the mantle 20 without touching the mantle 20. An equivalent means for creating contact areas would be to mask the areas prior to anodizing. Although only aluminum is discussed above as the material composition of the EMI shield 18, equivalent shields could be constructed from other conductors such as copper, but another method of applying the dielectric layer would have to be employed. The foregoing method of simply anodizing the components is both effective and economical owing to the relatively modest cost of aluminum, the dielectric strength of alumina, and the ease with which it is formed on the surfaces of the components. If two anodized aluminum plates $1.34\times10^{-3}$ m$^2$, each having an alumina coating of approximately 0.0002 inch, are pressed together, a capacitance of 0.01 microfarad is realized. It has been determined experimentally that a capacitance of only 0.001 microfarad is sufficient to provide adequate shielding for intensifier tubes now being used and that the aluminum/alumina shield 18 configuration described supplies the requisite capacitance.

Figure 3:
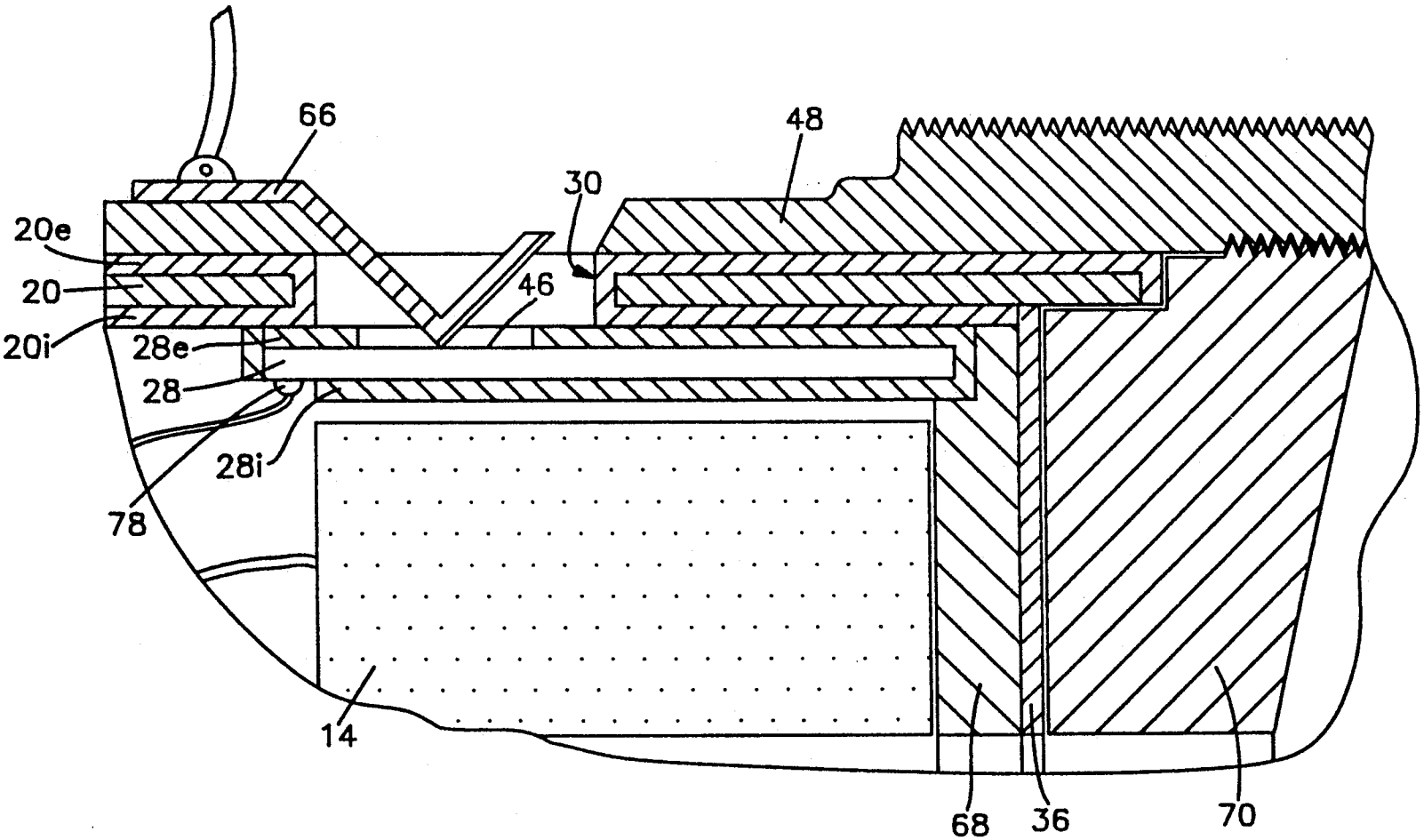
FIG. 3 is a magnified fragmental view of a portion of the device depicted in FIG. 2 proximate the spring contact.

Referring now to FIG. 3, there is shown a cross-sectional view of a single monocular housing 48 for containing a single image intensifier assembly 10. A pair of such housings 48 joined together by a suitable frame would constitute light intensifier binoculars or goggles to be used by an individual for viewing an otherwise dim visual field. Incident light from the field of view enters at the left through an input aperture 50. An optical lens held within a threaded cap for focusing the light and excluding dust from the housing would be in place covering the input aperture 50 when in use, but has been removed for simplicity of illustration. A similar lens received on the right side of the housing for output image focusing and dust occlusion has also been excluded for the sake of simplicity. Light entering the input aperture 50 impinges upon a cathode faceplate 52 having a photoelectron emissive layer 54 deposited on the rear surface thereof. Light impacting the emissive layer 54, causes photoelectrons to be emitted therefrom which are accelerated by an electric field towards a proximity focused microchannel plate 56 through which they are further accelerated under the influence of a second voltage differential. Upon exiting the microchannel plate 56 the electrons are further accelerated by yet another electrostatic field. After the third and final stage of acceleration, the electrons are proximity focused and collided into a fluorescent layer 58 deposited upon an output fiber optic array 60 where they are converted back to visible light which is conducted along the optic fibers and projected towards an output aperture 62. An optical lens (not shown) covering the output aperture would focus the output light signal for optimal viewing by the human eye. The plurality of stepped electrical potentials used to accelerate the photoelectrons through the tube are created by the power supply 14 which converts an input voltage having a potential of, e.g., +3V, to, e.g., −1.7 kV, −900V and +6V. In order to protect the aforementioned processes of electron emission, acceleration, transfer, and retranslation into photons, from electromagnetic interference, the aforementioned EMI shield 18 is employed. The EMI shield 18 is situated within the housing 48 surrounding the image intensifier tube 12 and power supply 14. In the embodiment shown, the intensifier tube 12 is supported within the EMI shield 18 by a cathode centerer and insulator 64 formed from a resilient electrical insulator such as hard rubber or plastic, e.g., polyphenylene oxide. The cathode centerer 64 receives the peripheral edges of the cathode faceplate within a mating annular relief and thereby insulates the cathode faceplate 52, and the intensifier tube 12 as a whole, from shocks, as well as, centering the tube 12 within the EMI shield 18. A pair of spring contacts 66 (only the positive input power lead is shown in this view) affixed to the exterior of the monocular housing 48, receive the input power B+ and B− leads to the intensifier tube. The spring contacts 66 project into the interior of the monocular housing 48 to electrically engage the EMI shield 18. The ground lead spring contact 66 (not shown) bears upon the exterior of the mantle 20 in a location that has been stripped of dielectric coating and treated for functioning as an electrical contact area. Thus the mantle 20 is maintained at ground potential. The positive input lead spring contact 66 passes through the contact window 30 in the mantle 20 and bears upon the contact area 46 on the sleeve 28, which area has been similarly stripped of dielectric and prepared for serving as a contact point. In practice, the openings in the monocular housing 48 through which the spring contacts 66 project would be sealed against the environment by a suitable sealing compound. The power supply 14 having a housing of electrically insulative composition and toroidal shape embraces and supports the fiber optic array 60 at the output end of the intensifier tube 12. The backplate 36 is preferably constructed of the same material as the mantle 20 and sleeve 28, namely, aluminum, and has a comparable thickness. The backplate 36 assists in shielding the tube 12 as part of the Faraday cage and therefore is held in electrically conductive association with the mantle 20. This can be accomplished in a number of ways. In the embodiment depicted, the backplate has not been anodized and is sized to be slideably received within the open end 22 of the mantle after the alumina coating in that area has been removed. Alternatively, the alumina coating on the threshold of the mantle could have prevented from being deposited by suitable masking. A distance piece 68 spaces the backplate 36 away from the sleeve 28 and presses the power supply 14 against the tube 12 forcing it to bear against the cathode centerer 64. The backplate 36 and/or the mantle 20 is urged into the monocular housing 48 by a threaded retainer ring 70 which is received by mating threads provided in the interior of the monocular housing 48. An equally feasible alternative is to displace the sleeve 28 towards the peripheral flange 24 end of the mantle 20 to allow the backplate 36 to contact the power supply 14 directly and urge it inwardly to its secured position without touching the sleeve 28. Although the sleeve 28 is coated with alumina and would not short to even a non-anodized backplate 36 with which it came in contact, it is retained in the mantle firmly and would not allow the backplate 36 to be pressed inwardly sufficiently enough to firmly secure the intensifier tube 12 if the sleeve 28 is positioned too close to the open end 22 of the mantle 20. A benefit is realized if the backplate 36, power supply 14, intensifier tube 12 and the distance piece (if used) is mechanically unified prior to insertion into the EMI shield by, e.g., gluing. If such preassembly is done, the subunit can be positioned within the EMI shield 18, the intensifier tube 12 powered, and the subunit rotated on its axis to displace any "S" distortion that my be inherent in the subunit into the vertical. "S" distortion, the distortion arising from radially changing image rotation, which occurs in the horizontal, is the most serious distortion for pilots, as it distorts the horizon or ground level perception. After the subunit has been rotated to the optimal position, the internal spaces may be filled with a dielectric "potting" filler which is injected into the intensifier assembly under pressure and then hardens to shock and weatherproof the image intensifier. In order to insure that the contact window 30 in the mantle 20 is aligned with the positive spring contact 66, an orientation lug 72 is provided which projects from the interior of the monocular housing 48 and is received in the registration notch 34. The power supply 14 positive or B+ input lead is soldered or otherwise conductively affixed to the sleeve 28 in an area in which the dielectric layer has been removed and pretreated. The negative ground or B− lead is similarly connected to a convenient location on the interior of the mantle 20. The threaded optical lens caps (not shown) would allow the focal point associated with each to be adjusted by their rotation. If the optical caps were adjusted inwardly towards the image intensifier assembly 10, the air trapped within say, the input aperture, would be compressed. In the event of an outward adjustment, a partial vacuum would result. If an unequal pressure is exerted on the intensifier assembly 10 there is a tendency for it to be displaced axially within the housing to relieve the unequal condition. To eliminate these conditions of unequal compression or vacuum the aforesaid air equalization groove 32 is employed. The groove allows air to pass from one side of the intensifier assembly 10 to the other.

Figure 2:
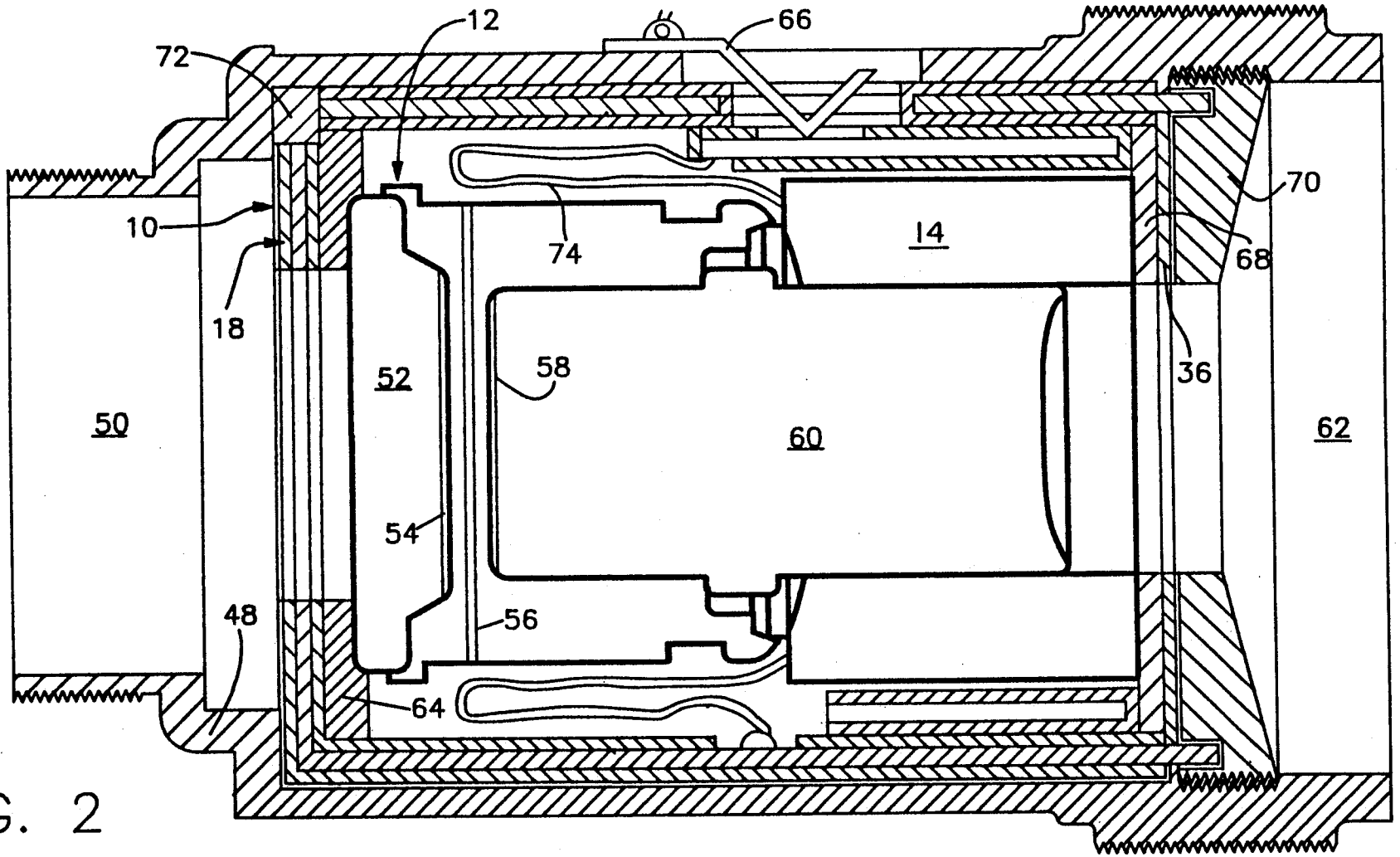
FIG. 2 is a cross-sectional view of the image intensifier assembly depicted in FIG. 1 in place within a monocular housing, taken along section line II—II and looking in the direction of the arrows.

Referring now to FIG. 3, wherein is shown an enlarged fragmented view of the spring contact area of the device depicted in FIG. 2, a better appreciation of the intermittent layers of aluminum and alumina etc., can be acquired. The alumina layer encapsulates both the mantle and the sleeve. Thus in cross-section, the mantle 20 exhibits an external layer 20*e* and an inner layer 20*i*. The sleeve similarly has an external layer 20*e* and an internal layer 28*i* of alumina. The dual layer of alumina 20*i* and 28*e* captured between the sleeve 28 and the mantle 20 constitutes the dielectric layer, which when sandwiched between two electrical conductors (the sleeve 28 and the mantle 20) allows the EMI shield 18 to function as a capacitor. The spring contact 66 for the positive (B+) lead passes through the contact window 30 in the mantle 20 and bears upon the sleeve 28 in a contact area 46 where the alumina layer has been removed. The B+ voltage is directed to the power supply 14 by affixing the appropriate B+ lead from the power supply to the sleeve at a suitably prepared attachment point 78. The mantle is grounded by a ground spring contact 66 (not shown) which contacts the mantle 20 through a discontinuity in the external alumina layer 20*e*. The ground lead of the power supply 14 affixes to the interior of the mantle 20 in a manner similar to the affixation of the B+ lead to the sleeve 28. The mantle 20 thus serves as the negative plate of the capacitor and the sleeve 28 is the positive plate.

Figure 4:
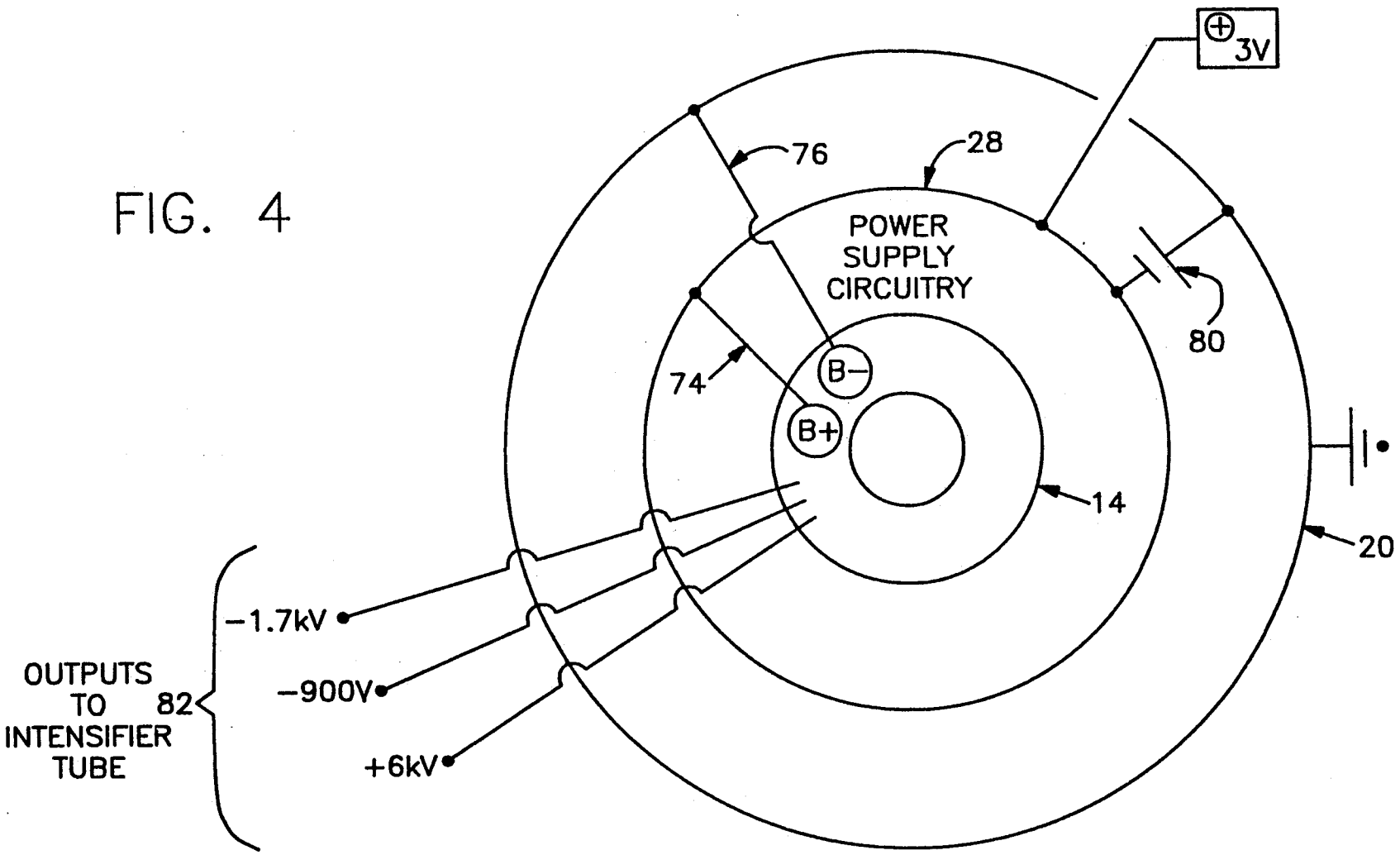
FIG. 4 is a circuit diagram depicting a shielding device in accordance with the present invention as part of an electrical circuit for powering an image intensifier.

Referring now to FIG. 4, the electrical significance and placement of the EMI shield within the image intensifier circuitry is there diagramatically illustrated. The input voltage (+3V used here for illustration) passes through the mantle 20 and connects to the sleeve 28 which is capacitively connected to the mantle 20 owing to their relative assembly and the alumina coating applied to each. This capacitive relationship is depicted by capacitor 80. The mantle 20 is grounded. The B+ and B− leads connect respectively to the sleeve 28 and the mantle 20. The capacitor 80 in this configuration serves to dampen and suppress noise induced on the input line by EMI. According to the present techniques, one employs a solder an flux obtained from the Indium Corporation of 1676 Lincoln Avenue, Utica, N.Y. 13503 which enables the soldering to anodized parts. In this manner, no masking is required. The flux removes the oxide enabling the solder to flow over the area. The backplate is then solder attached to the housing thus forming an electrical and mechanical bond. The power supply leads are soldered right to the anodized housing and insert.

An EMI shield/capacitor 18 constructed in accordance with the present invention is very effective in suppressing input line noise, especially noise appearing in the radio frequency range, and exhibits zero effective inductance. Given a steady input line voltage, a plurality of steady output voltages 82 are produced by the power supply 14 for powering the intensifier tube 12. The use of the EMI shield itself as a capacitor eliminates the need for separate conventional capacitor(s) which have proven to be a source of difficulty in that the capacitors were required to be very small to be able to fit within the monocular housing and due to their small size they had limited capacitance and were expensive and difficult to assemble and maintain. The present invention takes up minimal space within a portable image intensifier and may easily be employed to retrofit to existing units and designs; it is light in weight due to its aluminum construction and economical as it is formed from inexpensive materials through simple and inexpensive processes. It has been found that an EMI shield 18 in accordance with the present invention provides more than adequate capacitance for existing night vision goggles that have been retrofit with the device. In addition, the present invention has also been observed to render units in which it is incorporated more weather and humidity resistant, as well as, easier to assemble and disassemble for maintenance purposes.

It should be understood that the embodiments described herein are merely exemplary and that a person skilled in the art may make many variations and modifications without departing from the spirit and scope of the invention as defined in the appended claims.

I/We claim:

1. A device for shielding an image intensifier from electromagnetic interference comprising:

a) a Faraday Cage surrounding said image intensifier and over the end except for light input and output windows along its length, adapted to be electrically connected to a ground reference potential for diverting electromagnetic interference to said ground reference potential;

b) a conductive member fabricated within said Faraday Cage;

c) a dielectric substance interposed between said Faraday Cage and said conductive member;

d) said conductive member adapted to be electrically connected with an input lead for powering said image intensifier, said conductive member, said dielectric substance and said Faraday Cage forming a bypass capacitor for said input power lead.

2. A device in accordance with claim 1, wherein said Faraday Cage and said conductive member are cylindrical, said conductive member being received within said Faraday Cage coaxially and retained therein by friction.

3. A device in accordance with claim 2, wherein said Faraday Cage includes an inwardly directed flange for retaining said image intensifier within said Faraday Cage, said flange terminating inwardly in an aperture for admitting light to said image intensifier.

4. A device in accordance with claim 3, wherein said Faraday Cage and said conductive member are composed of aluminum and said dielectric substance is alumina.

5. A device in accordance with claim 4, further comprising a disk-shaped aluminum backplate having an approximately centrally located aperture for projecting light emanated by said image intensifier, said backplate having a diameter approximate to the internal diameter and comprising part of said Faraday Cage and being slideably receivable in said Faraday Cage distal to said flange, said backplate being held in electrically conductive association to complete said Faraday Cage when installed within said Faraday Cage but electrically insulated from said inter conductive member, said backplate capturing said image intensifier between said backplate and said flange.

6. A device in accordance with claim 5, wherein said Faraday Cage is slideably received within a tubular housing having a pair of spring contacts protruding into the interior thereof, said pair of contacts conductively attached to a power line pair leading from a power source, one spring contact receiving a positive voltage lead and the other receiving a ground lead.

7. A device in accordance with claim 6, wherein said ground spring contact electrically contacts said Faraday Cage and said positive voltage spring contact passes through a window formed in said Faraday Cage and contacts said conductive member, said positive voltage spring contact being electrically insulated from said Faraday Cage by said dielectric material and by an air gap between said positive voltage spring contact and the periphery of said window.

8. A device in accordance with claim 7, further including orientation means disposed on the exterior surface of said Faraday Cage and mating orientation means disposed within the interior hollow of said tubular housing for orienting said Faraday Cage within said housing to permit said spring contacts to contact said Faraday Cage and said conductive member at predetermined locations when said Faraday Cage is inserted in said housing.

9. A device in accordance with claim 8, wherein said Faraday Cage and said conductive member are substantially completely coated with an alumina coating, said coating being absent only in those areas requiring said Faraday Cage and said conductive member to receive a conductive electrical attachment.

10. A device in accordance with claim 9, wherein said areas receiving a conductive electrical attachment are coated by a conductor other than aluminum.

11. A device in accordance with claim 10, further including a disk-shaped centerer having a central aperture therein for permitting light to pass through, said centerer being received within said Faraday Cage and retained therein by said flange, said central aperture and said flange aperture coaxially aligning, said centerer receiving and supporting an end of said image intensifier within a peripheral relief around the perimeter of said central aperture.

12. A device in accordance with claim 11, wherein voids within said Faraday Cage when said image intensifier is contained therein are filled with a dielectric filler which hardens into a rubbery, shock absorbing, moisture excluding mass for insulating said image intensifier from shock and moisture.

13. A method for producing a device for shielding an image intensifier from electromagnetic interference having a cylindrical Faraday Cage surrounding said image intensifier at least along its length adapted to be connected to a ground reference potential for diverting electromagnetic interference to said ground reference potential, a cylindrical conductive sleeve disposed within said Faraday Cage, a dielectric substance interposed between said Faraday Cage and said conductive sleeve, said conductive sleeve adapted to be electrically connected with an input lead for powering said image intensifier, said conductive sleeve, said dielectric substance and said Faraday Cage forming a bypass capacitor for said input power lead comprising the steps of:

a) forming said Faraday Cage from an electrically conductive material;

b) forming said conductive sleeve from an electrically conductive material such that said sleeve has an outer diameter approximating the inter diameter of said Faraday Cage;

c) coating the outer surface of said sleeve with a dielectric;

d) heating said Faraday Cage to expand its internal diameter sufficient to allow said sleeve to be introduced into said Faraday Cage;

e) introducing said sleeve to said expanded Faraday Cage;

f) allowing said Faraday Cage to cool and return to its unexpanded state whereby said sleeve is gripped within said Faraday Cage and said dielectric coating is sandwiched between said sleeve and said Faraday Cage;

g) electrically connecting said sleeve to said input lead; and h) electrically connecting said Faraday Cage to ground 14. A device in accordance with claim 13, wherein said Faraday Cage and said conductive sleeve are each composed of aluminum and said dielectric substance is alumina, wherein said step of coating includes anodizing said sleeve to completely coat said sleeve with alumina and further comprising the steps of anodizing said Faraday Cage to completely coat said Faraday Cage with an outer layer of alumina after said Faraday Cage is formed, removing a small patch of alumina from said sleeve to expose the underlying aluminum sufficient to provide a contact point for said input lead prior to said step of electrically connecting said input lead to said sleeve, and removing a small patch of alumina from said Faraday Cage to expose the underlying aluminum sufficient to provide a contact point for a ground lead prior to said step of electrically connecting said Faraday Cage to ground.

15. A method in accordance with claim 14, wherein said areas receiving a conductive electrical attachment are coated by a conductive metal other than aluminum prior to receiving said attachment.

16. A device in accordance with claim 15, further including a disk-shaped aluminum backplate having an approximately centrally located aperture for projecting light emanated by said image intensifier therethrough, said backplate having a diameter approximating the internal diameter of said Faraday Cage and being slideably receivable in said Faraday Cage distal to said flange, said backplate being held in electrically conductive association with said Faraday Cage when installed within said Faraday Cage but electrically insulated from said sleeve, wherein said Faraday Cage includes an inwardly directed flange for retaining said image intensifier within said Faraday Cage, said flange terminating inwardly in a aperture for admitting light to said image intensifier, said backplate capturing said image intensifier between said backplate and said flange, wherein said step of forming said Faraday Cage includes forming said flange and further including the step of forming said backplate from aluminum.

17. A method in accordance with claim 16, wherein voids within said Faraday Cage with said image intensifier therein are filled with a dielectric filler which hardens into a rubbery, shock absorbing, moisture excluding mass for insulating said image intensifier from shock and moisture after said image intensifier is placed within said Faraday Cage.

18. A device for shielding an image intensifier from electromagnetic interference comprising:

a) a Faraday Cage surrounding said image intensifier and over the end except for light input and output windows along its length, adapted to be electrically connected to a ground reference potential for diverting electromagnetic interference to said ground reference potential, said Faraday Cage including an inwardly directed flange for retaining said image intensifier within said Faraday Cage, said flange terminating inwardly in an aperture for light to enter said image intensifier b) a conductive member located within said Faraday Cage;

c) a dielectric substance interposed between said Faraday Cage and said conductive member;

d) said conductive member adapted to be electrically connected with an input lead for powering said image intensifier, said conductive member, said dielectric substance and said Faraday Cage forming a bypass capacitor for said input power lead; and e) a backplate comprising part of said Faraday Cage and being slideably receivable in said Faraday Cage distal to said flange, said backplate having an approximately centrally located aperture for projecting light and being held in electrically conductive association to complete said Faraday Cage when installed within said Faraday Cage but electrically insulated from said conductive member, said backplate capturing said image intensifier between said backplate and said flange.

19. A device in accordance with claim 18, wherein said Faraday Cage is slideably received within a tubular housing having a pair of spring contacts protruding into the interior thereof, said pair of contacts conductively attached to a power line pair leading from a power source, one spring contact receiving a positive voltage lead and the other receiving a ground lead.

20. A device in accordance with claim 19, wherein said ground spring contact electrically contacts said Faraday Cage and said positive voltage spring contact passes through a window formed in said Faraday Cage and contacts said conductive member, said positive voltage spring contact being electrically insulated from said Faraday Cage by said dielectric material and by an air gap between said positive voltage spring contact and the periphery of said window.

21. A device in accordance with claim 20, further including orientation means disposed on the exterior surface of said Faraday Cage and mating orientation means disposed within the interior hollow of said tubular housing for orienting said Faraday Cage within said housing to permit said spring contacts to contact said Faraday Cage and said conductive member at predetermined locations when said Faraday Cage is inserted in said housing.

22. A device in accordance with claim 21, wherein said Faraday Cage and said conductive member are substantially completely coated with an alumina coating, said coating being absent only in those areas requiring said Faraday Cage and said conductive member to receive a conductive electrical attachment.

23. A device in accordance with claim 22, wherein said ares receiving a conductive electrical attachment are coated by a conductor other than aluminum.

24. A device in accordance with claim 23, further including a disk-shaped centerer having a central aperture therein for permitting light to pass through, said centerer being received within said Faraday Cage and retained therein by said flange, said central aperture and said flange aperture coaxially aligning, said centerer receiving and supporting an end of said image intensifier within a peripheral relief around the perimeter of said central aperture.

25. A device in accordance with claim 24, wherein voids within said Faraday Cage when said image intensifier is contained therein are filled with a dielectric filler which hardens into a rubbery, shock absorbing, moisture excluding mass for insulating said image intensifier from shock and moisture.

* * * * *